United States Patent [19]

Williamson

[11] Patent Number: 4,765,161

[45] Date of Patent: Aug. 23, 1988

[54] OUT-OF-BALANCE CONTROL FOR LAUNDRY MACHINES

[75] Inventor: George Williamson, Cincinnati, Ohio

[73] Assignee: American Laundry Machinery, Inc., Cincinnati, Ohio

[21] Appl. No.: 109,441

[22] Filed: Oct. 19, 1987

[51] Int. Cl.[4] ..... D06F 23/02; D06F 33/02; D06F 37/22

[52] U.S. Cl. ..... 68/12 R; 68/23.1

[58] Field of Search ..... 68/12 R, 23.1, 24

[56] References Cited

U.S. PATENT DOCUMENTS

| | | | |
|---|---|---|---|
| 3,674,419 | 7/1972 | Tichy | 68/23.1 X |
| 4,517,695 | 5/1985 | Hoffmann et al. | 68/23.1 X |
| 4,607,408 | 8/1986 | Didier et al. | 68/12 R X |

FOREIGN PATENT DOCUMENTS

| | | | |
|---|---|---|---|
| 2489384 | 3/1982 | France | 68/12 R |
| 2496136 | 6/1982 | France | 68/12 R |

*Primary Examiner*—Philip R. Coe
*Attorney, Agent, or Firm*—Bacon & Thomas

[57] ABSTRACT

An out-of-balance control for a laundry machine is described. The input to the control is a current signal which is proportionate to the current drawn by a motor which rotates a perforated drum into which fabric goods are loaded. When the drum is accelerated from a relatively low speed, employed to a washing cycle, to a somewhat higher, distribution speed, the input to the control is a "real time" signal which reflects variations in torque required to rotate the drum. The magnitude of these variations is proportional to load unbalance which can cause radial displacement of the drum, machine vibration and damage to its components. The real time signal is averaged. A differential amplifier then subtracts the "average" signal from the "real time" signal, providing an "unbalance torque" signal of alternating polarity. When the "unbalance torque" signal exceeds a given magnitude, reflecting the maximum permissible centrifugal force to be generated by load unbalance, an "unbalance control" signal is generated. The main control of the machine is responsive to this last signal to reduce the rotational speed of the drum.

6 Claims, 1 Drawing Sheet

OUT-OF-BALANCE CONTROL FOR LAUNDRY MACHINES

Figures 1, 2:
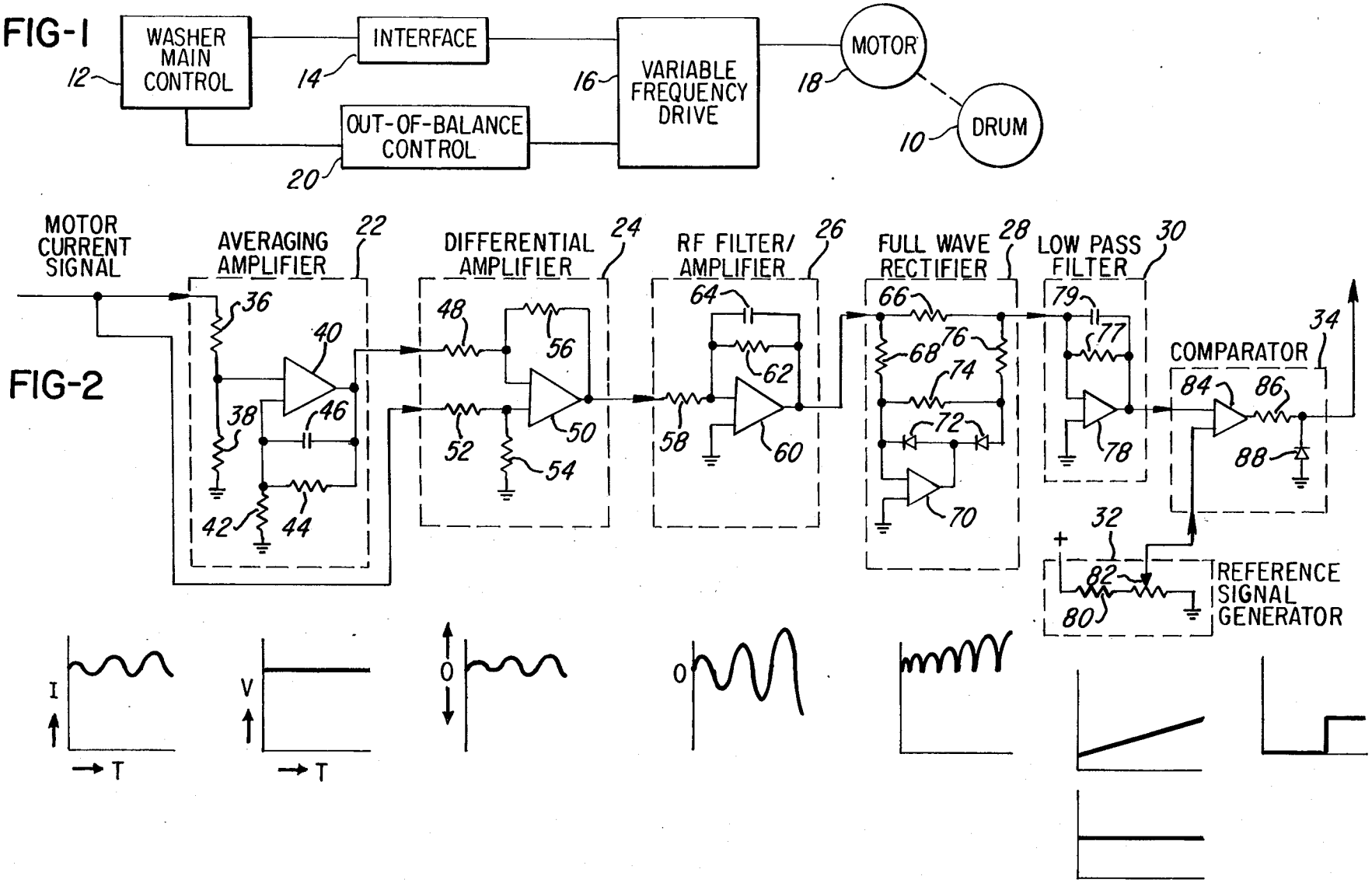

The present invention relates to improvements in out-of-balance controls for laundry machines, or the like.

Laundry machines having a rotatable, perforated cylinder, or drum, are well known for both commercials and domestic use. The drum is disposed within a housing and may be disposed on a vertical or horizontal axis, the latter being more typical of laundry machines for commercial use.

After fabric goods, or the like, are loaded into the drum, a main control may be actuated. Such controls program the operation of the various mechanisms comprising the laundry machine. While there are many variations, typically there will be a wash cycle, a spin cycle involving rotation of the drum for extraction of liquid by centrifugal force, a rinse cycle and a further spin cycle.

In machines where the drum rotates about a vertical axis, an agitator is generally provided and typically oscillates to facilitate the washing action. In machines where the drum rotates about a horizontal axis, generally, the drum rotates at a relatively low speed so that the fabric goods are tumbled to provide agitation for facilitating the washing action.

It is a well recognized problem that extreme vibration of these machines will be produced if the wet goods are not evenly distributed about the axis of the drum when it is accelerated to the high speeds employed in the spin cycle. Such load unbalance conditions can cause out-of-balance, centrifugal forces which, under worst case conditions, can cause the drum to break free from its mountings. Even moderate out-of-balance loads will cause vibration which significantly reduce the service life of the bearings and other components of the machine.

These problems are exacerbated in commercial laundry machines, where the drum is mounted for rotation about a horizontal axis. Drum diameters can be as great as 44 inches, or more, with washing load weight in the order or 125 pounds. In the wash cycle, a relatively low rate of rotation is employed. The final spin speed of the drum, for liquid extraction generates centrifugal forces several times the force of gravity. With these extreme speeds, the criticallity of a load unbalance becomes more acute. In recognition of this fact, it is an accepted practice to first accelerate the drum to a distribution speed wherein the centrifugal force generated by the load approximates two "g's". The drum is thereafter accelerated to the higher, liquid extraction speed where centrifugal forces approaching 300 "g's" are generated.

Many solutions have been proposed for this problem. Primarily these solutions are predicated on the use of a mechanical means to detect displacement of the drum to sense displacement of the basket due to an unbalanced load. Usually this involves the use of a switch which actuates means for reducing the rate of drum rotation. In some case the motor is shut down to permit manual redistribution of the load. In other cases, the control will reduce the drum speed to permit the load to redistribute itself and then automatically reaccelerate the drum, in the expecation that a balance has been achieved.

One of the problems in the use of switches is a lack of sensitively. That is, a fairly high magnitude of drum displacement is required to actuate the switch. Relatively high forces may thus be generated before a speed reduction occurs to remove the stresses on the rotor bearings and other components of the machine. This is further complicated by the fact that switches are vulnerable to malfunction as a result of vibrations. They are, thus, not as reliable as would be desired.

A further problem, also related to sensitivity, is that the sensing means are not responsive to load unbalance conditions until the drum has reached its relatively high, spin speeds, where the resultant centrifugal forces are at a level which will cause damage.

There are, additionally, limited teachings of the use of electrical means for detecting an unbalanced load condition, as found in U.S. Pat. No. 2,917,175. To the best of applicant's knowledge there has been no commercial acceptance of other than "mechanical" detection means.

In the referenced patent, it is recognized that motor current varies as a function of torque variations resulting from load unbalance which produce the undesirable centrifugal forces on the drum. However, it is there proposed to detect the phase shift in the current drawn by the motor as a means for detecting load unbalance centrifugal forces which cause variations in the torque required to rotate the drum.

Accordingly, the primary object of the invention is to provide an improved out-of-balance control for laundry machines and the like.

Another object of the invention is to provide improved sensitivity in detecting an out-of-balance condition and thereby minimize the centrifugal loads, and vibrations, to which the machine is subjected.

Another object of the invention is to sense an out-of-balance condition condition at relatively low drum speeds, minimizing out-of-balance loads on the machine as well as increasing the probability that a load will have the ability to properly redistribute itself, without the need for manual intervention.

These ends are broadly attained in a laundry machine, or the like, comprising a perforated drum in which goods are place for washing. Electric motor drive means are provided for rotating the drum. Main control means include means for controlling the electric motor drive means. These means include means for rotating the drum at a relatively slow speed during a wash cycle, accelerating the drum to a distribution speed and then accelerating rotation of the drum to a relatively high speed in a spin cycle to extract liquid from the goods within the drum.

An out-of-balance control is provided for preventing damage to the machine from centrifugal force resulting from an unbalanced load, when the drum is rotating at an extraction speed.

The out-of-balance control comprises means for deriving, from the electric motor drive means, a "real time" signal proportionate to the current drawn by the motor. This current is proportionate to the torque required to rotate the drum. This torque requirement varies, cyclically, in magnitude, in proportion to any unbalance in the load within the rotating drum and the centrifugal forces generated thereby.

Means then average this "real time" signal. The averaging means has a time constant which provides an "average" signal proportionate to the current drawn by the motor during a relatively few number of revolutions.

Means are then employed for differentiating the "average" signal and the "real time" signal to provide an "unbalance torque" signal of alternating polarity. The amplitude of the "unbalance torque" signal is proportionate to variations in motor torque resulting from centrifugal forces generated by load unbalance.

Finally, means responsive to the amplitude of the "unbalance torque" signal exceeding a preset magnitude (representing the maximum permissible unbalance centrifugal force) are provided for generating an "unbalance control" signal. This signal, in turn is employed, through the main control and electric motor drive means to reduce the rate of rotation of the drum.

The above and other related objects and features of the invention will be apparent from a reading of the following description of a preferred embodiment of the invention and the novelty thereof pointed out in the appended claims.

In the drawings:

FIG. 1 is a block diagram of a laundry machine incorporating the present out-of-balance control; and FIG. 2 is a schematic diagram of the present out-of-balance control, broken down into its block diagram components and illustrating control signals generated therein.

The out-of-balance control, of the present invention is primarily adapted for use in laundry machines, and more particularly to washers of the type comprising a perforated drum 10 (FIG. 1) into which fabric goods, such as clothing, may be placed. The drum is disposed within a closed container into which water may be introduced for a washing cycle, which can involve agitation of the fabric goods. The water is then evacuated. Next the drum can be a rinse cycle and then a spin cycle in which the drum is rotated at high speed to extract most of the water from the fabric goods, by centrifugal action.

There are a wide variety of cycle sequences employed in washing machines, as well as a wide range of duration of the time for any individual cycle. The present invention finds particular utility in commercial washing machines wherein the drum is mounted for rotation about a horizontal axis. A washer main control, identified by reference character 12, may comprise manually operated switches for selecting a desired cycle sequence, as well as the time for a given sequence, such as the wash cycle. The control 12 may employ microprocesser circuitry which generates digital signals which are transmitted to an interface board 14 to generate analogue signals. The analogue signals provide a control input to a variable frequency drive 16, which controls a drive motor 18 for the drum 10.

The main control 12 generates the necessary signals for actuating, and sequencing, the various valves, pumps and other accessory items employed in washing machines. For purposes of the present invention, it is sufficient to understand that this control provides the input for controlling the variable frequency drive for the drive motor 18. The variable frequency drive is, likewise, a known, variable speed drive means for electrical motor which, relatively recently, has enabled elimination of more cumbersome mechanical means for driving the drums of washing machines.

The main control 12, employed herein, is, preferably of a known type which cause rotaiton of the drum 10 at a relatively low speed during the wash cycle. For purposes of relative values, this speed would be 35 r.p.m. This speed, for a 44 inch diameter drum, generates centrifugal forces of approximately 0.7 "'g", resulting in a tumbling action of the load to facilitate the washing action. When this cycle is complete (and water evacuated) the drum is accelerated to a distribution speed wherein the centrifugal forces generated approximate 2 "g's" at a speed of 60 r.p.m. After the load is stablilized at the distribution speed, the drum is accelerated to the high speed required for liquid extraction. This may be done in steps, illustrated by spin cycle speeds of 350 r.p.m and then 700 r.p.m.

In any event, it is when the drum 10 is accelerated to these spin speeds, that an unbalance of the fabric load in the drum 10 can become a problem. To avoid this problem and prevent rotation of an unbalanced load at speeds which would generated centrifugal forces capable of reducing the useful life of the various components of the washer, an input signal is provided from the variable frequency drive 16 to an out-of-balance control 20. As will now be described in detail, the out-of-balance control 20 generates a signal input to the main control 12 which, in turn, generates a signal input to the variable frequency drive, causing a reduction in motor speed.

The variable frequency drive 16 provides a continuous input signal to the out-of-balance control 20. This input signal is a "real time", current signal, proportionate to the power drawn by the motor 18 in rotating the drum 10. It is illustrated at the bottom left portion of FIG. 2.

FIG. 2 further illustrates the elements of the out-of-balance control in block diagram form. The signal forms generated by these elements are then illustrates below the respective elements of the control.

Functionally, it will be seen that that the "real time", input signal to the control 20 is a variable d.c. signal. The variations in the strength of this signal are proportionate to the variations in the torque requirements for rotating the drum. When there is a load unbalance, there is a radial force of varying magnitude which results in a correspondingly varying torque requirement in rotating the drum. The magnitude of the differential between the minimum and maximum levels of the current (power) signal is proportionate to the out-of-balance, centrifugal force on the drum. The frequency of the variation in this signal strength is directly proportional to the rate of rotation of the drum 10. The average strength of the input signal is proportional to the power required to rotate the drum. That is, all things being equal, the heavier the load in the drum, the greater the power required to rotate it at a given speed.

With these factors in mind, the "real time" input signal is fed to an averaging amplifier 22, the output of which is an "average" signal having a strength reflecting the average torque, over a relatively few revolutions, for driving the drum 10.

This "average" signal becomes one input to a differential amplifier 24, the other input for which is the "real time", input signal from the variable frequency drive 16. The output signal from the differential amplifier is then an "unbalance torque" signal of alternating polarity, the magnitude of which is proportional to the variations in torque requirements resulting from an unbalanced load. This, in turn, reflects the resultant, undesirable forces to which the drum bearings and other components of the machine would be subjected.

The following means then are employed to generate an "unbalance control" signal when the load unbalance exceeds a preset limit. The "unbalance control" signal is then employed to reduce drum speed as will be more fully explained.

The output of the differential ampliifer may be fed to an amplifier 26 which provides the further function of filtering out extraneous "noise", or radio (high) frequencies, in addition to amplifying the "unbalance torque" signal.

The "unbalance torque", alternating current signal is next converted to an averaged, single polarity, direct current signal by a full wave rectifier 28 and a low pass filter 30.

A reference signal generator 32 provides one input to a comparator 34. The other input to the comparator 34 is the averaged "unbalance torque" signal. The strength of the "reference" signal represents the maximum permissible, load unbalance, centrifugal force for the machine. When the strength of the averaged, "unbalance torque" signal exceeds the strength of the "reference" signal, the "unbalance control" signal is generated and is transmitted from the comparator 34 to the main control 12. In response to an "unbalance control" signal the main control 12 provides an appropriate signal input, through the interface board 14 and variable frequency drive 16, to reduce the speed of the motor 18 and the drum 10.

It is to be noted that the level of the "reference" signal is set to be responsive to the maximum load unbalance, at the relatively low distribution speed of the drum, which does not produce unacceptable unbalance load forces on the drum, when it is further accelerated to the much higher speeds employed for liquid extraction, in the spin cycle.

In further illustration, the "real time" signal (bottom left, FIG. 2) is illustrated with a progressively increasing amplitude, illustrating an increasing centrifugal force being generated by a load unbalance as the drum is accelerated to its distribution speed. The "average" signal remains at a constant strength, being a function of load weight. The "unbalance torque" signal progressively increases in amplitude, again reflecting the increase in centrifugal force resulting from load unbalance. Note, the time increment is insufficient to reflect an increase in "average" torque, as the speed of rotation is increased.

The further amplification of the "torque unbalance" signal and its rectification and averaging results in a progressively increasing signal strenth input to the comparator 34. When the strength of this d.c. "unbalance torque" signal exceeds the strength of the "reference" signal, the "unbalance control" signal is generated and fed to the main control 12, and the speed of the drum reduced to its tumbling speed, for redistribution of the load. The main control is programmed to then reaccelerate the drum 10 to its distribution speed, with the expectation being that the load will be properly balanced for acceleration of the drum to its load extraction, spin cycle speeds.

The components of the out-of-balance control 20 will now be described in greater detail. The averaging amplifier circuit 24 may comprise input resistors 36, 38, across which the "real time" current signal is impressed. The voltage signal thus generated provides one input to a high gain amplifier 40. A feedback circuit comprising resistors 42, 44 and capacitor 46 filter out the pulsating portion of the power signal, to provide a signal which reflects the average power drawn by the motor 18. The time constant provided by this feedback is, approximately, the time for 3–4 revolutions of the drum 10, at its distribution speed.

The differential amplifier circuit 24 may comprise an input resistor 48 through which the "average" signal is fed to an amplifier 50. The "real time" signal is fed through input resistors 52, 54 to provide a second input to the amplifier 50. A feedback resistor 56 completes the differential amplifier circuit 24. The resistors 52, 54 function as scaling resistors, to the end that the output of the differential amplifier 24, subtracts the "real time" signal from the "average" signal. The output "unbalance torque" signal then reflects the variations in power requirement caused by load unbalance.

The RF filter/amplifier circuit 26 may comprise an input resistor 58 connected to one input of an amplifier 60, the other input of which is connected to ground. The filtering function is provided by a feedback circuit comprising a resistor 62 and a capacitor 64. The values of the feedback circuit are selected to filter out frequencies substantially greater than the 60 cycle/minute variations in signal strength proportionate to the distributional speed of the drum and, more particularly "noise", i.e., relatively high frequencies which frequently become imposed on the primary signal in high gain amplification.

The full wave rectifier circuit 28 may comprise input resistors 66, 68, providing one input to an amplifier 70, the other input of which is connected to ground. A feedback circuit is provided by diodes 72 and a resistor 74. An output resistor 76 completes this circuit.

The low pass filter circuit 30 may comprise an amplifier 78, having the pulsating d.c. output of the rectifier 28 connected to one input, with the other input connected to ground. A feedback circuit, comprising resistor 77 and capacitor 79, provides the desired filtering action.

The reference signal generator 32 may comprise a potentiometer 80 connected to across a regulated d.c. power supply source to ground, with an adjustable, outlet tap 82. The outlet tap is adjusted to set the strength of the "reference" signal to reflect the maximum unbalance forces which are to be permitted when the drum 10 is at its liquid extraction speeds.

The comparator circuit 34 may comprise an amplifier 84 output resistor 86 and diode 88.

Selection of the several components of the out-of-balance control 20 would be within the abilities of one skilled in the art, recognizing that relatively low voltage potentials would be employed, consistant with known safety practices.

In a more specific sense, it is contemplated that the drum 10 rotates about a horizontal axis. The washer main control 18 comprises means for generating signals which, through the interface 14 and variable frequency drive 16, powers the motor to rotate the drum at a rate generating less than one "g" forces in the fabrics being washed. The materials are thus carried part way up the drum and then tumble downwardly to provide an agitation which enhances the washing action. For purposes of illustration, with a drum diameter of 44 inches, a speed of 35 r.p.m., generating approximately 0.7 "g" is satisfactory.

After a preset time, the wash water may be automatically evacuated by a pump. The output signal of the main control then causes the drum 10 to accelerate, relatively slowly (8–10 seconds), to a distribution speed of 60 r.p.m., generating approximately two "g's".

In this distribution cycle, the various items of the load being washed, as a general rule, become equally distributed about the inner surface of the drum, with only minimal centrifugal forces acting to displace the drum from its axis of rapidly accelerated first to 350 rpm for a finite period, and then to 700 rpm, generating "g" forces of 70 and 280, respectively. Obviously any load imbalance, at these higher speeds, would result in "g" forces which could be destructive.

The out-of-balance control of the present invention is devised to essentially eliminate destructive centrifugal forces by detecting unbalanced load conditions during the distribution cycle. When such condition is detected, the main control reduces the drum rotation to the wash or tumble speed for a finite period, and, then reaccelerates the drum speed to the distribution speed. This recycling through the distribution cycle can be repeated, as desired, and, then if an unbalanced condition persists, the machine shut down for manual adjustment of the load.

The provision of means for providing the functions described in connection with the main control 12, interface 14 and variable frequency drive 16 are all within the abilities of one skilled in the art and do not require specific desrction.

It will be apparent that variations of the described embodiment of the invention will occur to those skilled in the art within the spirit of the present invention. Accordingly, the scope of the present invention is to be derived from the following claims.

Having thus described the invention, what is claimed as novel and desired to be secured by Letters Patent of the United States is:

1. In a laundry machine, or the ike, comprising a perforated drum in which goods are placed for washing, electric motor drive means for rotating said drum, main control means, for said machine, having means for controlling said electric drive means and rotation of said drum, including means for accelerating rotation of said drum to a relatively high rate of rotation for the extraction of liquid from goods therein, by centrifugal force;

an out-of-balance control for preventing damage to the machine from centrifugal forces resulting from an unbalanced load when the drum is rotating at an extraction speed, said out-of-balance control comprising means for deriving, from the electric motor drive means, a "real time" current signal proportionate to the current drawn by said motor, such current being, in turn, proportionate to the torque required to rotate the drum, the torque requirement for the motor varying cyclically in proportion to any unbalance in the load within the rotating drum and the centrifugal forces generated thereby, means for averaging said "real time" signal, the time constant for said averaging means being such that the "average" signal output is proporationate to the average current drawn by the motor during a relatively few number of rotations, means for differentiating said "average" signal from said "real time" signal, to provide an "unbalance torque" output signal of alternating polarity, the amplitude of which is proportionate to variations in motor torque resulting from centrifugal forces generated by load unbalance, means responsive to the amplitude of the "unbalance torque" signal exceeding a preset magnitude (representing a maximum permissible unbalance centrifugal force), for generating an "unbalance control" output signal, and means responsive to said "unbalance control" signal for reducing the rate of rotation of said drum.

2. In a laundry machine, or the like, an out-of-balance control as in claim 1, wherein the means for generating an "unbalance control" signal comprise means for rectifying the "unbalance torque" signal to a single polarity signal and filtering said signal with a time constant providing an averaged "unbalance torque" signal reflecting the unbalance torque current over a relatively few revolutions of the drum, means for generating a "reference signal", the magnitude of which represents the maximum unbalance torque load to be permitted, and means for comparing the averaged "unbalanced torque" signal and the reference signal and generating said "unbalance control" signal when the averaged "unbalanced torque" signal exceeds the reference signal.

3. In a laundry machine, or the like, an out-of-balance control as in claim 1, wherein the means for averaging the "real time" signal comprise an operational amplifier, the differentiating means comprise a differential amplifier, said "real time" signal being one input thereto and the "average" signal being the other input thereto, and the means for generating an "unbalance control" signal comprising a full wave rectifier and low pass filter to which the alternating polarity, "unbalance torque" signal is fed to provide a direct current "unbalance torque" signal averaged over a relatively few revolutions of the drum, means for generating a direct current "reference" signal having a magnitude representing the maximum unbalance torque load on the motor, and means for comparing said reference signal and said averaged "unbalance torque" signal and generating said "unbalance control" signal when the averaged "unbalance torque" signal exceeds said "reference" signal.

4. In a laundry machine, or the like, as in claim 3 whereing the means for generating a "reference" signal comprise a potentiometer connected to a source of fixed voltage, the output of the variable tap of the potentiometer being adjusted to provide a "reference" signal of desired strength.

5. In a laundry machine, or the like, as in claim 3, wherein the out-of-balance control further comprises a second operational amplifier interposed between the differential amplifier and the full wave rectifier, for amplifying the "unbalance torque" signal, said second operational amplifier having a filter feedback for eliminating signals of a frequency substantially greater than the frequency of the distribution speed, from the "unbalance torque signal".

6. In a laundry machine , or the like, as in claim 3 wherein the drum rotates about a horizontal axis, the main control and electric motor drive means rotate the drum at a speed generating approximately 0.7 "g" on the load therein, during a wash cycle, whereby the load is tumbled to facilitate washing action, then, automatically accelerates said drum to a distribution speed generating a loading of approximately 2 "g's" for a limited period of time and then further accelerates rotation of said drum to a speed generating a loading of several "g's" for extraction of the major portion of liquid from said load, further characterized in that the reference signal is set to limit permissible unbalance torque to a level detectable during the initial acceleration of the drum.

* * * * *